US009639028B2

(12) United States Patent
Horii et al.

(10) Patent No.: US 9,639,028 B2
(45) Date of Patent: May 2, 2017

(54) IMAGE FORMING APPARATUS AND CONTAINER FOR DEVELOPER

(71) Applicant: FUJI XEROX CO., LTD., Tokyo (JP)

(72) Inventors: Kiyohito Horii, Kanagawa (JP); Seigo Shinozaki, Kanagawa (JP); Makoto Kanno, Kanagawa (JP); Shota Oba, Kanagawa (JP); Norihiro Tamazawa, Kanagawa (JP); Ayumi Noguchi, Kanagawa (JP); Shigeru Inaba, Kanagawa (JP); Shinichiro Fujimori, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/806,107

(22) Filed: Jul. 22, 2015

(65) Prior Publication Data

US 2016/0259267 A1 Sep. 8, 2016

(30) Foreign Application Priority Data

Mar. 6, 2015 (JP) ..... 2015-045098

(51) Int. Cl.
*G03G 15/08* (2006.01)

(52) U.S. Cl.
CPC ..... *G03G 15/0872* (2013.01)

(58) Field of Classification Search
CPC ..... G03G 2215/0668; G03G 2215/067; G03G 2215/0665
See application file for complete search history.

(56) References Cited

U.S. PATENT DOCUMENTS 5,515,143 A * 5/1996 Shiotani ..... G03G 15/0886 141/364
5,878,307 A * 3/1999 Greenlaw ..... G03G 15/0868 399/106

(Continued)

FOREIGN PATENT DOCUMENTS

JP 9-160362 A 6/1997
JP 2005-77660 A 3/2005

(Continued)

OTHER PUBLICATIONS

Communication dated Jul. 13, 2016, issued by the Australian Patent Office in counterpart Australian Application No. 2015218457.

(Continued)

*Primary Examiner* — Sevan A Aydin
(74) *Attorney, Agent, or Firm* — Sughrue Mion, PLLC

(57) ABSTRACT

A container for developer detachably mountable to an image forming apparatus body includes a container body, a discharge member, a resistive member, and a resistance reduction mechanism. The container body contains developer and is rotated when drive is transmitted from the image forming apparatus body. The discharge member supports the container body rotatable relative to the discharge member and has a discharge port through which the developer is discharged. The resistive member is brought into contact with the container body so as to apply resistance to the rotation of the container body. The resistance reduction mechanism changes a contact state between the resistive member and the container body so as to reduce the resistance between the resistive member and the container body when the container is mounted to the image forming apparatus body.

6 Claims, 9 Drawing Sheets

(56) References Cited

U.S. PATENT DOCUMENTS

| | | | | |
|---|---|---|---|---|
| 6,334,037 | B1 * | 12/2001 | Ise | G03G 15/0868 399/260 |
| 7,764,909 | B2 | 7/2010 | Nakajima et al. | |
| 7,920,811 | B2 | 4/2011 | Murase et al. | |
| 2007/0092302 | A1 * | 4/2007 | Koyama | G03G 15/0868 399/258 |
| 2008/0181674 | A1 * | 7/2008 | Kaiho | G03G 15/0886 399/262 |
| 2009/0129813 | A1 * | 5/2009 | Nagashima | G03G 15/0865 399/119 |
| 2010/0189463 | A1 * | 7/2010 | Shimomura | G03G 21/1676 399/119 |
| 2011/0026973 | A1 * | 2/2011 | Hosokawa | G03G 15/0872 399/258 |
| 2013/0156470 | A1 * | 6/2013 | Mochizuki | G03G 15/0867 399/258 |

FOREIGN PATENT DOCUMENTS

| | | | | |
|---|---|---|---|---|
| JP | 2009086289 | A | * | 4/2009 |
| JP | 2009-229938 | A | | 10/2009 |
| WO | 2014147847 | A1 | | 9/2014 |

OTHER PUBLICATIONS

Communication dated Nov. 16, 2016 from the Australian Government Intellectual Property Office in counterpart Application No. 2015218457.

* cited by examiner

IMAGE FORMING APPARATUS AND CONTAINER FOR DEVELOPER

CROSS-REFERENCE TO RELATED APPLICATIONS

This application is based on and claims priority under 35 USC 119 from Japanese Patent Application No. 2015-045098 filed Mar. 6, 2015.

BACKGROUND

Technical Field

The present invention relates to an image forming apparatus and a container for developer.

SUMMARY

According to an aspect of the present invention, a container for developer detachably mountable to an image forming apparatus body includes a container body, a discharge member, a resistive member, and a resistance reduction mechanism. The container body contains developer and is rotated when drive is transmitted from the image forming apparatus body. The discharge member supports the container body rotatable relative to the discharge member and has a discharge port through which the developer is discharged. The resistive member is brought into contact with the container body so as to apply resistance to the rotation of the container body. The resistance reduction mechanism changes a contact state between the resistive member and the container body so as to reduce the resistance between the resistive member and the container body when the container is mounted to the image forming apparatus body.

BRIEF DESCRIPTION OF THE DRAWINGS

Exemplary embodiments of the present invention will be described in detail based on the following figures, wherein:

FIG. 6A is the explanatory view of a state in which a shutter has been moved to a closed position, and FIG. 6B is the explanatory view of a state in which the shutter has been moved to an open position;

FIG. 7A is the explanatory view of a state in which a shutter has been moved to a closed position, and FIG. 7B is the explanatory view of a state in which the shutter has been moved to an open position;

FIG. 9A is an explanatory view of a state of the toner cartridge with screws tightened, and FIG. 9B is an explanatory view of a state of the toner cartridge with the screws loosened.

DETAILED DESCRIPTION

Figure 1:
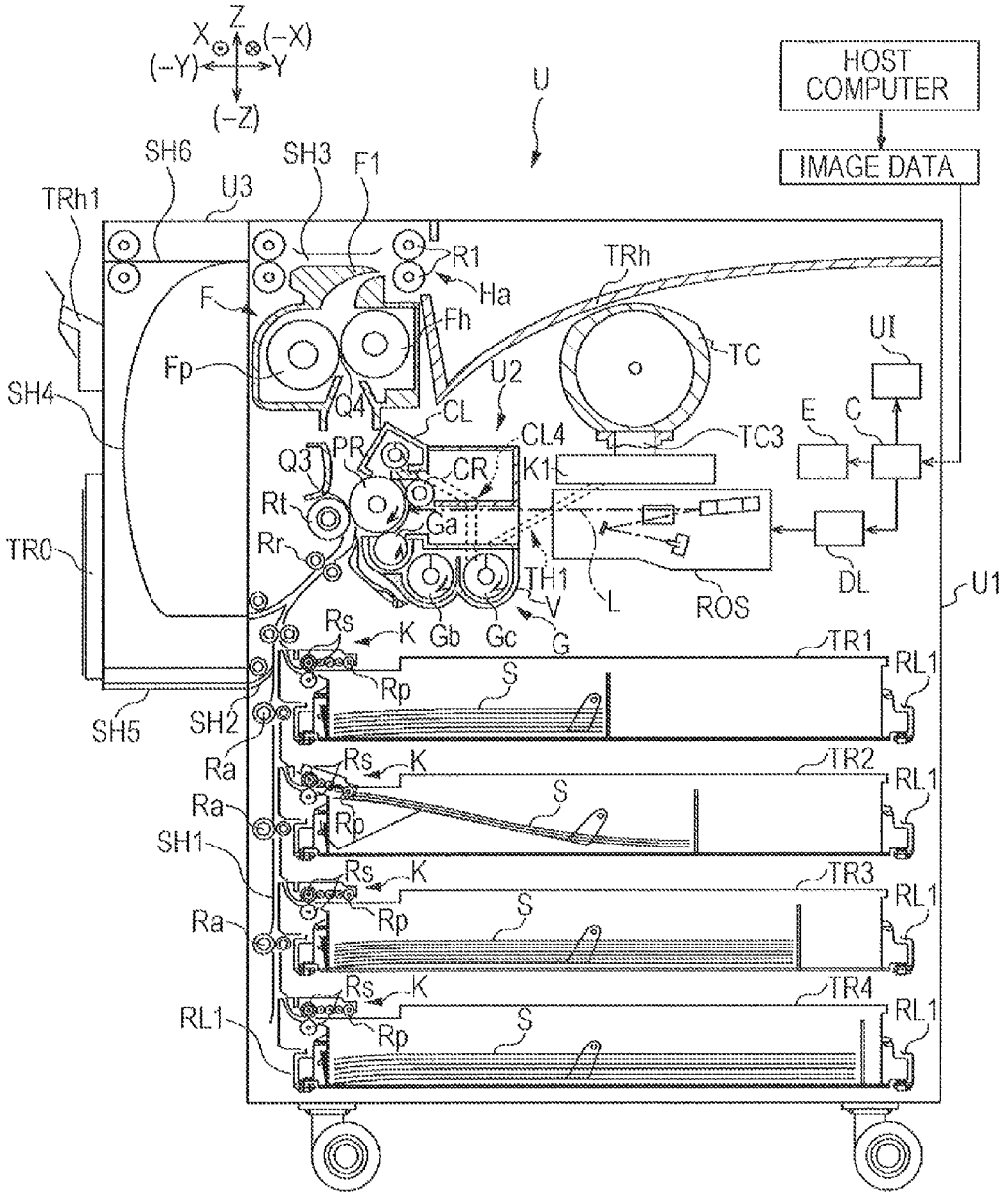
FIG. 1 is an overall explanatory view of an image forming apparatus according to a first exemplary embodiment.

Next, specific examples of exemplary embodiments of the present invention (referred to as exemplary embodiments hereafter) will be described with reference to the drawings. It is to be understood that the present invention is not limited to the following exemplary embodiments.

For ease of understanding of the description hereafter, the front-rear direction, the left-right direction, and the vertical direction in the drawings are respectively defined as the X direction, the Y direction, and the Z direction. Directions or sides indicated by arrows X, -X, Y, -Y, Z, and -Z are respectively indicate the front, rear, right, left, upper, and lower directions or sides.

Also, circles marked with dots therein and circles marked with "x"s therein illustrated in the pages of the drawings respectively indicate arrows extending from the back side to the front side of the pages and arrows extending from the front side to the back side of the pages.

It is noted that, in the following description with reference to the drawings, elements other than those required for the description may be omitted from the drawings as appropriate for ease of understanding.

First Exemplary Embodiment

FIG. 1 is an overall explanatory view of an image forming apparatus according to a first exemplary embodiment.

In FIG. 1, a printer U that serves as an example of an image forming apparatus according to the first exemplary embodiment includes a printer body U1 that serves as an example of an image forming apparatus body. A first output tray TRh that serves as an example of a first medium output unit is provided in an upper surface of the printer body U1. An operation unit UI is provided in the upper surface of a right portion of the printer body U1. The operation unit UI includes components such as a display (not illustrated). The operation unit UI allows a user to perform an input operation therewith.

A host computer is illustrated as an example of an image information transmitting device for the printer U according to the first exemplary embodiment, and specifically, a personal computer is electrically connected to the printer U.

The printer U includes a controller C that serves as an example of a controller. The controller C is capable of receiving electrical signals such as image information and a control signal transmitted from the personal computer PC. The controller C is also capable of outputting control signals to the operation unit UI and a power source circuit E. Furthermore, the controller C is electrically connected to a writing circuit DL.

The writing circuit DL outputs a driving signal to a light exposure device ROS in accordance with information input thereto. The light exposure device ROS serves as an example of a writing device. The light exposure device ROS is capable of outputting a laser beam L in accordance with a signal input thereto. The laser beam L serves as an example of writing light.

Figure 2:
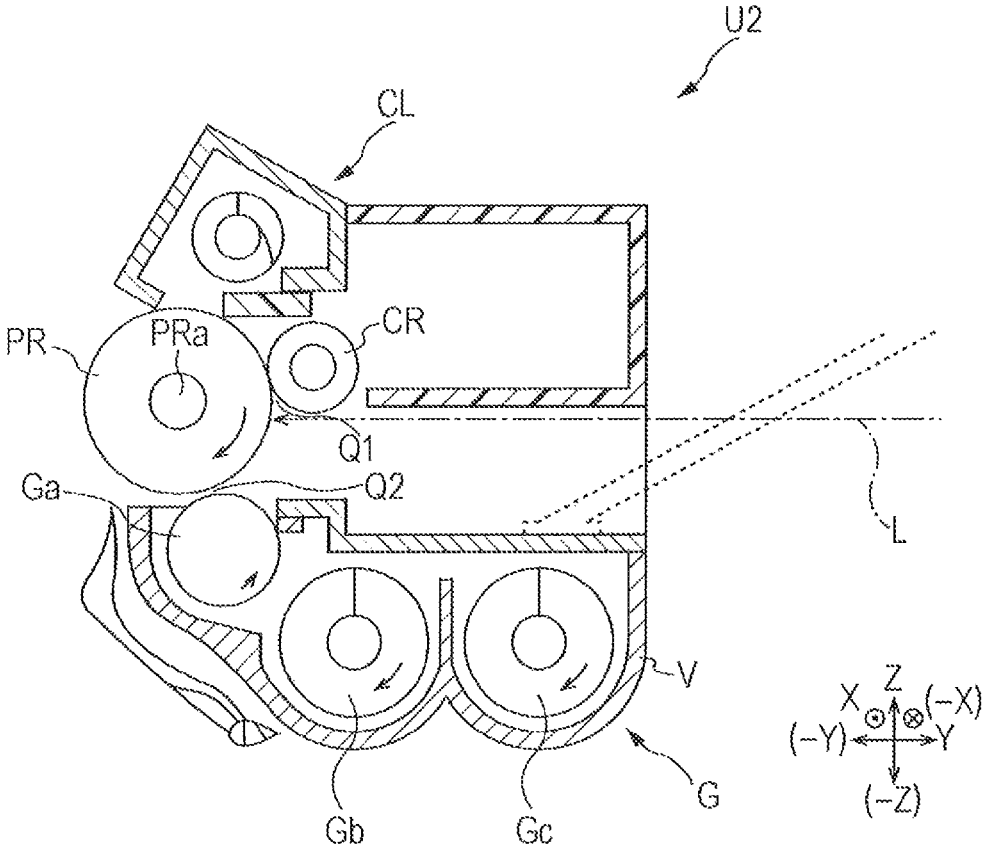
FIG. 2 is an enlarged view of part of a toner image forming device illustrated in FIG. 1.

FIG. 2 is an enlarged view of part of a toner image forming device illustrated in FIG. 1.

Referring to FIGS. 1 and 2, a photosensitive body PR that serves as an example of an image holding body is disposed to the left of the light exposure device ROS. The photosensitive body PR according to the first exemplary embodiment is supported such that the photosensitive body PR is rotatable about a rotational shaft PRa in an arrow direction. The photosensitive body PR has a writing region Q1 that is irradiated with the laser beam L.

A charging roller CR, a developing device G, and a photosensitive-body cleaner CL are arranged in a rotational direction of photosensitive body PR around the photosensitive body PR. The charging roller CR serves as an example of a charging member. The photosensitive-body cleaner CL serves as an example of a cleaning device for the image holding body.

In the printer U according to the first exemplary embodiment, the photosensitive body PR, the charging roller CR, the developing device G, and the photosensitive-body cleaner CL are integrated with one another to form a unit that is detachably attached. That is, the photosensitive body PR, the charging roller CR, the developing device G, and the photosensitive-body cleaner CL are included in a process unit U2 that is detachably attached to the printer body U1.

A charging voltage is applied from the power source circuit E to the charging roller CR.

The developing device G includes a developing container V therein. The developing container V contains toner that serves as an example of developer. A developing roller Ga that serves as an example of a developer holding body is rotatably supported in the developing container V. The developing roller Ga faces the photosensitive body PR in a developing region Q2.

Furthermore, a developing voltage is applied from the power source circuit E to the developing roller Ga. Augers Gb and Gc are rotatably supported in the developing container V. The augers Gb and Gc each serve as an example of a developer transport member.

The toner image forming device that forms a toner image on the photosensitive body PR includes the components such as the photosensitive body PR, the charging roller CR, the light exposure device ROS, and the developing device G.

One end of a replenishing path of a toner replenishing device TH1 is connected to the developing container V. The toner replenishing device TH1 that serves as an example of a developer replenishing device is secured to and supported by the printer U. The other end of the replenishing path of the toner replenishing device TH1 is connected to a toner cartridge TC that serves as an example of a container for developer.

The toner cartridge TC is detachable from and mountable to the printer U by removing and inserting in the front-rear direction.

Referring to FIG. 1, plural sheet feed trays TR1 to TR4 are provided in a lower portion of the printer U. The plural sheet feed trays TR1 to TR4 each serve as an example of a medium containing unit. The plural sheet feed trays TR1 to TR4 contain recording sheets S. Each of the sheets S serves as an example of a medium.

In FIG. 1, rails RL1 are disposed on the left and right sides of each of the sheet feed trays TR1 to TR4. The rails RL1 each serve as an example of a container guide member. Left and right end portions of the sheet feed trays TR1 to TR4 are movably supported by the rails RL1. Thus, each of the sheet feed trays TR1 to TR4 is supported by a corresponding pair of the left and right rails RL1 such that each of the sheet feed trays TR1 to TR4 is capable of being drawn and retracted in the front-rear direction.

Referring to FIG. 1, a sheet feed device K is disposed to the upper left of each of the sheet feed trays TR1 to TR4. The sheet feed devices K each include a pickup roller Rp that serves as an example of a medium pickup member. A separation roller set Rs that serves as an example of a separation member is disposed to the left of the pickup roller Rp. The separation roller set Rs includes a feed roller and a retard roller. The feed roller serves as an example of a medium transport member. The retard roller serves as an example of medium parting member.

A sheet feed path SH1 that serves as an example of a medium transport path is disposed to the left of the sheet feed devices K. The sheet feed path SH1 extends upward. Plural transport rollers Ra are disposed along the sheet feed path SH1. Each of the transport rollers serves as an example of a medium transport member. A registration roller Rr that serves as an example of a medium transport timing adjustment member is disposed at an upper end of the sheet feed path SH1, which is a downstream end of the sheet feed path SH1.

Furthermore, a manual feed tray TR0 that serves as an example of a manual feed unit is attached on a left side portion of the printer U. A left end of a manual feed path SH2 that serves as an example of a manual feed transport path is connected to a right portion of the manual feed tray TR0. A right end of the manual feed path SH2 is connected to the sheet feed path SH1.

Referring to FIG. 1, a transfer roller Rt that serves as an example of a transfer device is disposed above the registration roller Rr. The transfer roller Rt faces and is in contact with the photosensitive body PR in a transfer region Q3. Thus, the transfer roller Rt according to the first exemplary embodiment is rotated by rotation of the photosensitive body PR. A transfer voltage is applied from the power source circuit E to the transfer roller Rt.

The photosensitive-body cleaner CL is disposed on the downstream of the transfer roller Rt in the rotational direction of the photosensitive body PR. A collection path CL4 that serves as an example of a developer transport path is supported in the photosensitive-body cleaner CL. The collection path CL4 extends from the photosensitive-body cleaner CL to the developing device G.

Referring to FIG. 1, a fixing device F is supported above the transfer roller Rt. The fixing device F includes a heating roller Fh and a pressure roller Fp. The heating roller Fh serves as an example of a heat fixing member. The pressure roller Fp serves as an example of a pressure fixing member. The heating roller Fh and the pressure roller Fp are in contact with each other in a fixing region Q4. A drive is transmitted from a drive source (not illustrated) to the heating roller Fh, thereby rotating the heating roller Fh. Also, power used to heat a heater (not illustrated) is supplied from the power source circuit E to the heating roller Fh.

An image recording section U2+Rt+F that records an image on the sheet S includes the process unit U2 that serves as an example of the toner image forming device, the transfer roller Rt, and the fixing device F.

A sheet guide F1 that serves as an example of a medium guide unit is formed on the upper portion of the fixing device F. Sheet output rollers R1 are disposed to the right of the sheet guide F1. The sheet output rollers R1 each serve as an example of a medium output member. A medium output opening Ha is formed to the right of the sheet output rollers R1. The first output tray TRh is disposed below the medium output opening Ha.

Referring to FIG. 1, a connection path SH3 that serves as an example of a medium transport path is disposed at a position above the fixing device F and to the left of the sheet output rollers R1. The connection path SH3 extends leftward from the medium output opening Ha.

An inversion unit U3 that serves as an example of a medium inversion device is supported above the manual feed tray TR0 on the left side surface of the printer body U1. An inversion path SH4 that serves as an example of a medium transport path is formed in the inversion unit U3. An upper end of the inversion path SH4 is connected to a left end of the connection path SH3. A lower end of the inversion path SH4 is merged with the sheet feed path SH1 on the upstream of the registration roller Rr.

Furthermore, a second output path SH6 that serves as an example of a medium transport path is formed in an upper portion of the inversion unit U3. A right end of the second output path SH6 is connected to the connection path SH3. The second output path SH6 branches from the inversion path SH4. A left end of the second output path SH6 extends to a left side surface of the inversion unit U3. A face up tray TRh1 that serves as an example of a second output unit is supported on the left side surface of the inversion unit U3. Thus, the sheet S having passed through the second output path SH6 may be output to the face up tray TRh1. Functions of the Image Forming Apparatus Image information transmitted from the personal computer PC is input to the controller C of the printer U according to the first exemplary embodiment having the above-described structure. The controller C converts the image information input thereto into latent image forming information at preset timing and outputs the latent image forming information to the writing circuit DL. The light exposure device ROS outputs the laser beam L in accordance with a signal received by the writing circuit DL. The controller C controls operations of the operation unit UI, the writing circuit DL, the power source circuit E, and so forth.

Referring to FIGS. 1 and 2, a surface of the photosensitive body PR is charged by the charging roller CR to which the charging voltage is applied. The surface of the photosensitive body PR charged by the charging roller CR is irradiated with and scanned by the laser beam L from the light exposure device ROS in the writing region Q1, thereby an electrostatic latent image is formed. The surface of the photosensitive body PR on which the electrostatic latent image has been formed sequentially passes through the developing region Q2 and the transfer region Q3.

The developing roller Ga faces the photosensitive body PR in the developing region Q2. The developing roller Ga is rotated while holding developer in the developing container V on the surface of the developing roller Ga. Thus, the electrostatic latent image on the surface of the photosensitive body PR is developed into a toner image by the toner held on the surface of the developing roller Ga. The toner image serves as an example of a visual image. The developer in the developing container V is circulated while being agitated by the augers Gb and Gc.

As the development is performed with the developing roller Ga, the developer in the developing container V is consumed. As the developer in the developing container V is consumed, the developing container V is replenished with the developer from the toner cartridge TC. That is, in accordance with the amount of consumed developer, the toner in the cartridge TC is transported to the discharge port TC3. The toner discharged through the discharge port TC3 is transported to the developing container V by a replenishing transport member (not illustrated) in the replenishing path of the toner replenishing device TH1.

The sheets S on which images are to be recorded are contained in the sheet feed trays TR1 to TR4. The sheets S contained in the sheet feed trays TR1 to TR4 are picked up by the pickup rollers Rp of the sheet feed devices K. The separation roller sets Rs each separate one sheet after another from the sheets S having been picked up by a corresponding one of the pickup rollers Rp. Each of the sheets S having been separated by the separation roller sets Rs is fed into the sheet feed path SH1. The sheet S is transported toward the registration roller Rr by the transport rollers Ra through the sheet feed path SH1.

The sheet S fed from the manual feed tray TR0 is transported to the registration roller Rr through the manual feed path SH2. The sheet S having been transported to the registration roller Rr is transported to the transfer region Q3 by the registration roller Rr at timing adjusted to timing at which the toner image on the surface of the photosensitive body PR is moved to the transfer region Q3.

The toner image on the surface of the photosensitive body PR is transferred onto the sheet S that is passing through the transfer region Q3 by the transfer roller Rt to which the transfer voltage is applied in the transfer region Q3.

Referring to FIG. 2, the toner attracted to the surface of the photosensitive body PR having passed through the transfer region Q3 is removed by the photosensitive-body cleaner CL. Thus, the photosensitive body PR is cleaned. The toner removed by the photosensitive-body cleaner CL is returned into the developing container V through the collection path CL4. That is, the developer collected by the photosensitive-body cleaner CL is reused by the developing device G.

After the surface of the photosensitive body PR has been cleaned by the photosensitive-body cleaner CL, the photosensitive body PR is charged again by the charging roller CR.

The sheet S onto which the toner image has been transferred in the transfer region Q3 is transported to the fixing region Q4 of the fixing device F. At this time, the toner image on the sheet S has not been fixed.

The sheet S is interposed between the heating roller Fh and the pressure roller Fp in the fixing region Q4, so that the toner image is heat fixed.

The sheet S onto which the toner image has been fixed by the fixing device F is guided by the sheet guide F1 so as to be transported to the sheet output rollers R1. In the case where the sheet S is output to the first output tray TRh, the sheet S having fed to the sheet output rollers R1 is output to the first output tray TRh through the medium output opening Ha.

When duplex printing is performed, the sheet output rollers R1 are rotated in the reverse direction when a trailing end in a transport direction of the sheet S has passed through the sheet guide F1. At this time, the image has been recorded on a first side of this sheet S. Thus, the sheet S is transported into the inversion path SH4 through the connection path SH3. The sheet S having transported through the inversion path SH4 is transported in the inverted state to the registration roller Rr. Thus, the sheet S is transported from the registration roller Rr to the transfer region Q3 again, and an image is recorded in a second side of the sheet S.

Figure 3:
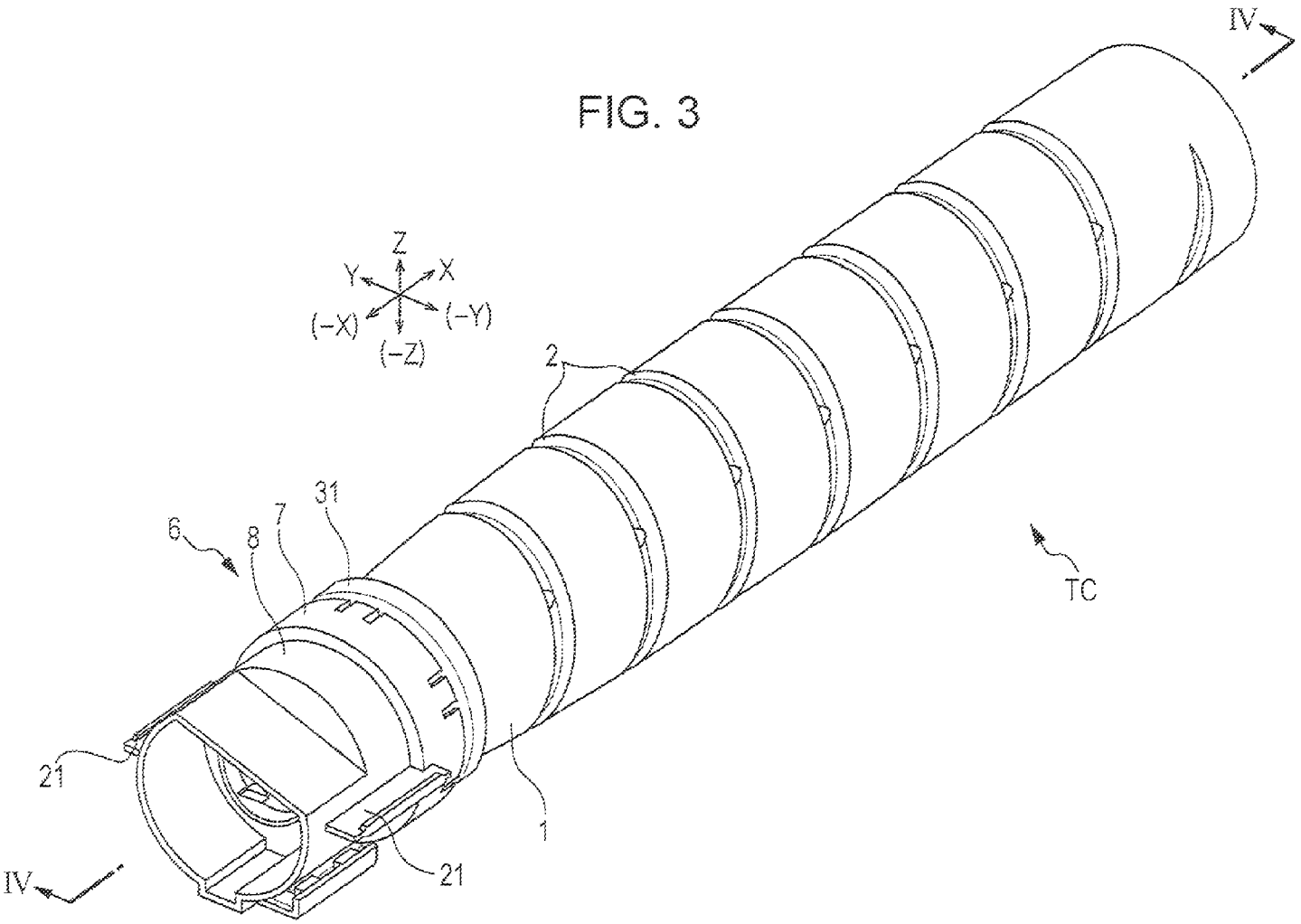
FIG. 3 is a perspective view of a toner cartridge according to the first exemplary embodiment.
Figure 4:
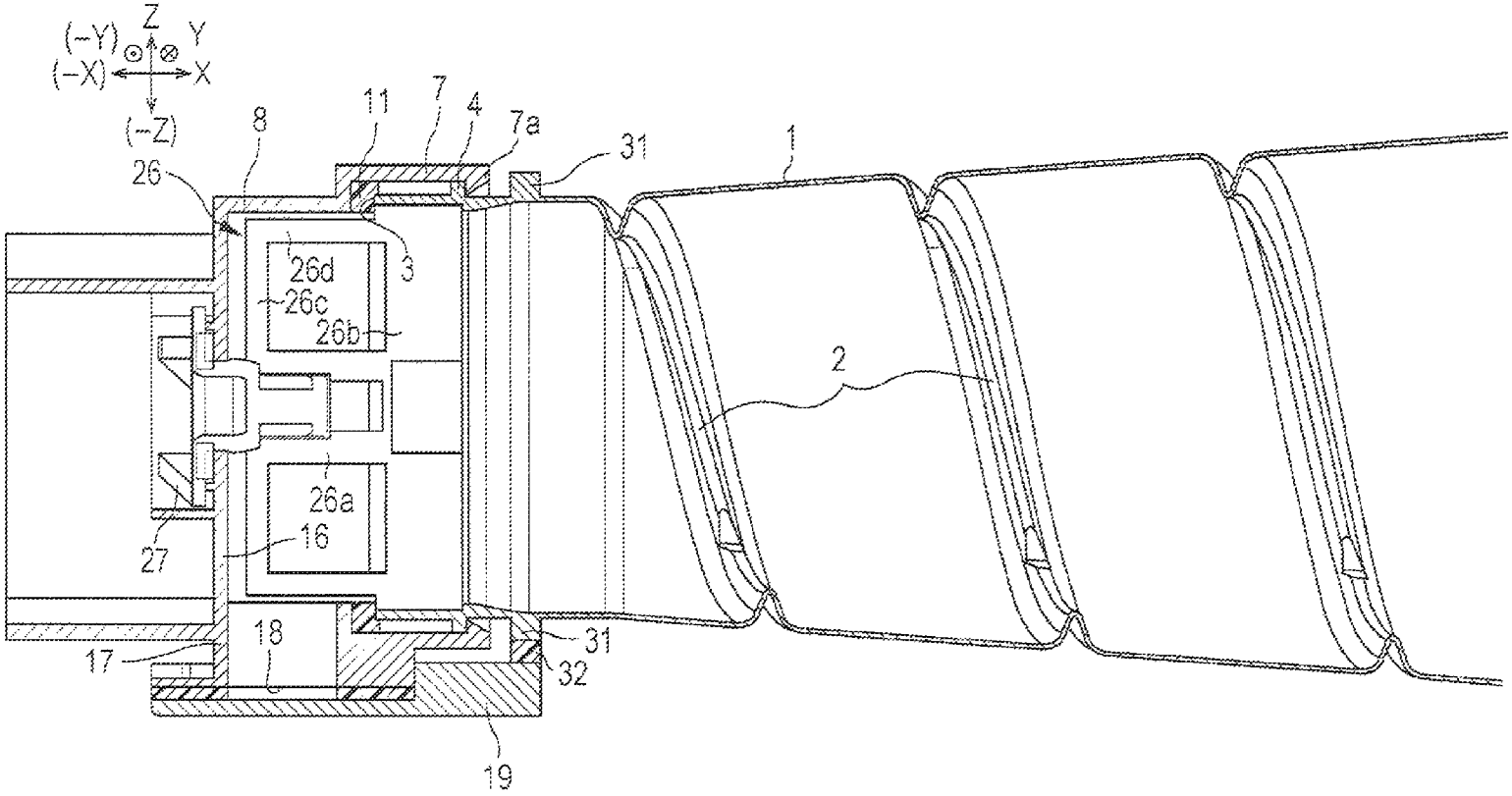
FIG. 4 is a sectional view of the toner cartridge illustrated in FIG. 3 taken along line IV-IV illustrated in FIG. 3.

When the sheet S is output to the face up tray TRh1, the sheet S transported through the connection path SH3 by the reverse rotation of the sheet output rollers R1 is transported into the second output path SH6. The sheet S having been transported through the second output path SH6 is output to the face up tray TRh1. Description of the Toner Cartridge FIG. 3 is a perspective view of the toner cartridge according to the first exemplary embodiment. FIG. 4 is a sectional view of the toner cartridge illustrated in FIG. 3 taken along line IV-IV illustrated in FIG. 3.

Figure 5:
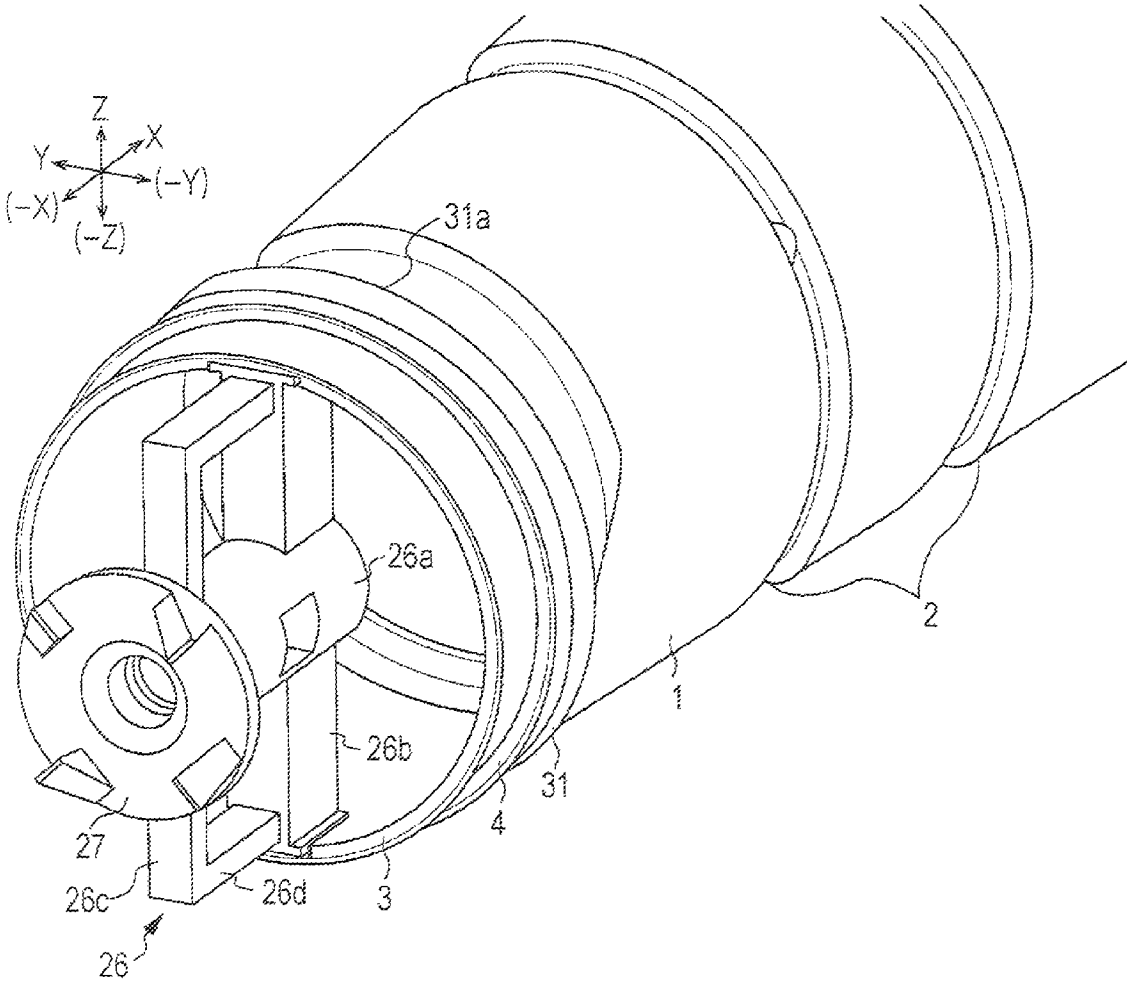
FIG. 5 is an explanatory view of the toner cartridge illustrated in FIG. 3 with a flange member removed.

FIG. 5 is an explanatory view of the toner cartridge illustrated in FIG. 3 with a flange member removed.

Referring to FIGS. 3 to 5, the toner cartridge TC according to the first exemplary embodiment includes a bottle 1 that serves as an example of a container body. The bottle 1 has a cylindrical shape extending in the front-rear direction and is capable of containing the developer therein. The bottle 1 has a helical groove portion 2 that serves as an example of a transport portion in its wall surface. Referring to FIGS. 4 and 5, the bottle 1 has an opening 3 at its rear end. A ring-shaped retainer 4 that extends outward in the radial directions is formed in front of the opening 3.

A flange member 6 that serves as an example of a discharge member is supported at a rear end of the bottle 1. The flange member 6 has a cylindrical shape. The flange member 6 includes a large diameter portion 7 at its front portion and a small diameter portion 8 at its rear portion.

An inner diameter of the large diameter portion 7 is larger than an outer diameter of the rear end of the bottle 1. A retainer 7*a* that extends inward in the radial directions is formed at a front end of the large diameter portion 7.

Furthermore, an inner diameter of the small diameter portion 8 is smaller than the outer diameter of the rear end of the bottle 1. A seal 11 that serves as an example of an anti-leakage member and that also serves as an example of a tightly closing member is supported at a front end surface of the small diameter portion 8. Thus, the rear end of the bottle 1 is inserted into the large diameter portion 7, and, as illustrated in FIG. 4, the retainer 4 of the bottle 1 is supported by engagement of the retainer 4 with the retainer 7*a* of the large diameter portion 7. Thus, the bottle 1 is rotatably supported relative to the flange member 6. In this state, the rear end of the bottle 1 is pressed against the seal 11 and supported so as not to allow leakage of the developer from the inside of the bottle 1.

Furthermore, the small diameter portion 8 has a plate-shaped wall portion 16 at its central portion in the front-rear direction. The wall portion 16 extends in the up-down direction and the left-right direction. The small diameter portion 8 also has a discharge channel 17 that extends downward in its lower portion. A discharge port 18 that serves as an example of an outflow port is formed at a lower end of the discharge channel 17.

A shutter 19 that serves as an example of an opening and closing member is slidably supported in the front-rear direction below the discharge channel 17.

Referring to FIG. 3, insertion guides 21 that each serve as an example of a portion to be guided are formed on an outer circumferential surface of the small diameter portion 8. The insertion guides 21 are guided by guiding portions (not illustrated) provided in the printer body U1 that serves as the example of the image forming apparatus body when mounting the toner cartridge TC.

Referring to FIGS. 4 and 5, a fin structure 26 that serves as an example of a crumbling member is disposed in front of the wall portion 16 in the small diameter portion 8. The fin structure 26 includes a shaft portion 26*a* that extends in the front-rear direction. Support arms 26*b* that extend outward in the radial directions are formed at a rear end of the shaft portion 26*a*. The support arms 26*b* each serve as an example of a crumbling part and also serve as an example of a portion to be supported. The support arms 26*b* are in contact with an inner circumferential surface of the rear end of the bottle 1 so as to be supported. That is, the fin structure 26 and the bottle 1 are integrally rotatably supported relative to the flange member 6.

First crumbling parts 26*c* are formed on a rear portion of the shaft portion 26*a*. The first crumbling parts 26*c* extend outward in the radial directions. Second crumbling parts 26*d* are formed between outer ends of the first crumbling parts 26*c* in the radial directions and the support arms 26*b*. The second crumbling parts 26*d* extend in the front-rear direction.

A coupling 27 that serves as an example of a drive receiving member is supported at a rear end of the shaft portion 26*a*. The coupling 27 is rotatably supported by the wall portion 16. When the toner cartridge TC is mounted to the printer body U1, the coupling 27 is engaged with a coupling supported by the printer body U1, thereby receiving drive.

Figure 6A:
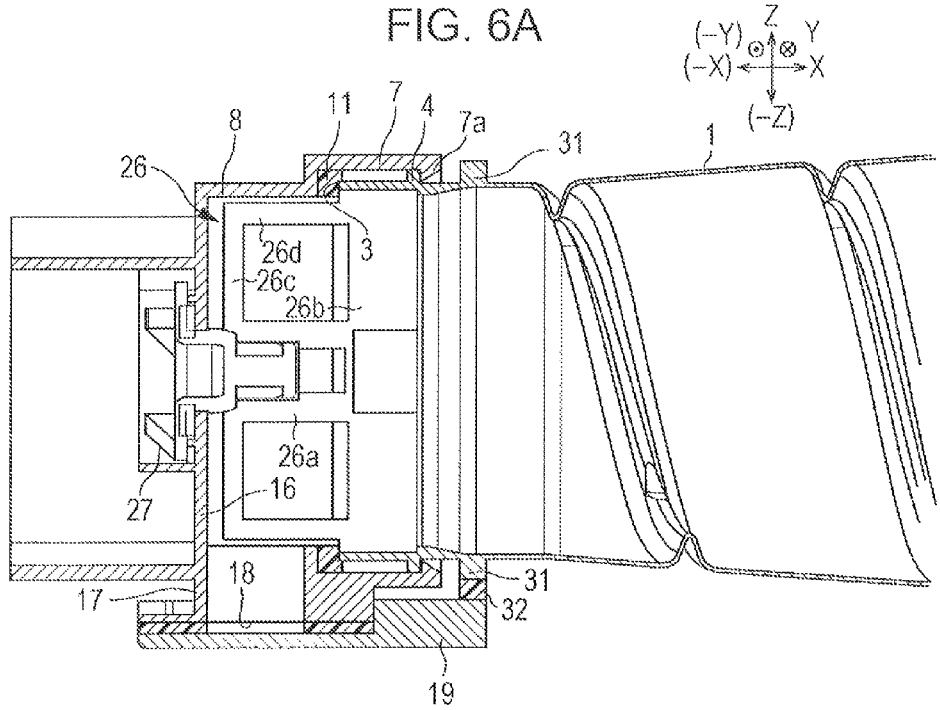
FIGS. 6A and 6B are explanatory views of a torque adjustment mechanism according to the first exemplary embodiment, and out of FIGS. 6A and 6B.
Figure 6B:
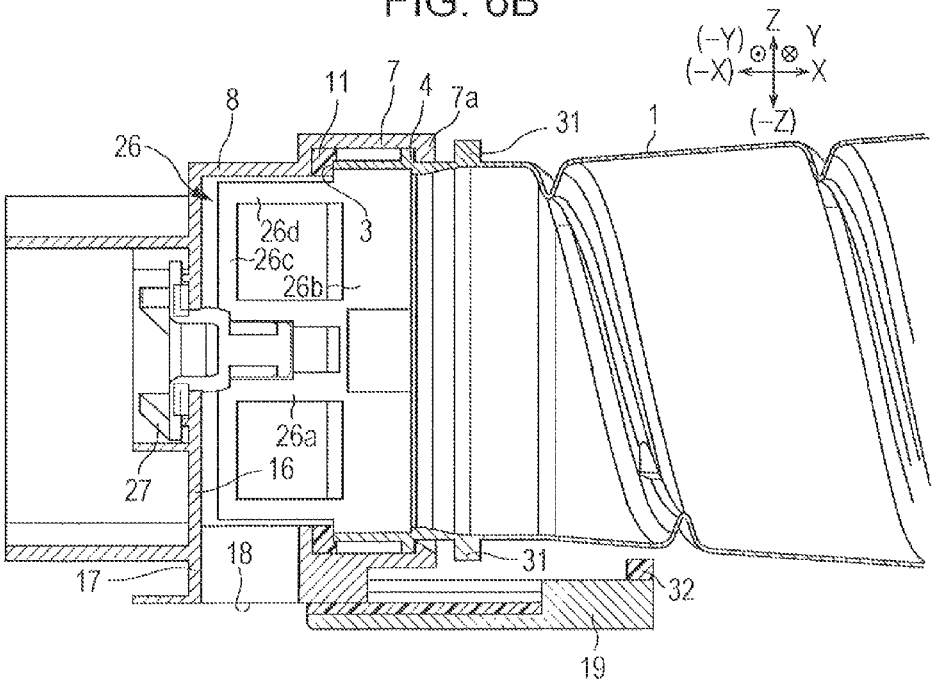

FIGS. 6A and 6B are explanatory views of a torque adjustment mechanism according to the first exemplary embodiment. FIG. 6A is the explanatory view of a state in which the shutter has been moved to a closed position, and FIG. 6B is the explanatory view of a state in which the shutter has been moved to an open position.

Referring to FIGS. 3 to 6B, a ring-shaped projection 31 is formed in front of the retainer 4 on an outer circumferential surface of the bottle 1. Referring to FIGS. 4, 6A, and 6B, a brake rubber 32 that serves as an example of a resistive member is supported at a front end of the shutter 19 that serves as an example of a resistance reduction member according to the first exemplary embodiment. When the shutter 19 is moved to the closed position illustrated in FIG. 6A where the shutter 19 closes the discharge port 18, the brake rubber 32 is disposed at a position where the brake rubber 32 is in contact with the projection 31.

A resistance reduction mechanism according to the first exemplary embodiment includes the shutter 19, the projection 31, and the brake rubber 32.

Various known related-art structures may be adopted for the structure for moving the shutter 19 as the toner cartridge TC is inserted and removed. Thus, the detailed description of the structure for the moving of the shutter 19 as the toner cartridge TC is inserted and removed is omitted.

Operation of First Exemplary Embodiment

In the printer U according to the first exemplary embodiment having the above-described structure, when the toner cartridge TC is mounted to the printer body U1, the fin structure 26 and the bottle 1 are rotated in accordance with consumption of the toner. When the bottle 1 is rotated, the developer is transported rearward along the helical groove portion 2. Thus, it is not necessarily required that a rotating transport member be disposed in the bottle 1 of the toner cartridge TC according to the first exemplary embodiment, and accordingly, the manufacturing cost of the toner cartridge TC may be reduced.

The toner replenishing device TH1 is replenished with the developer transported rearward along with rotation of the bottle 1 through the discharge port 18. When the bottle 1 is rotated, the fin structure 26 is also rotated. Thus, the toner closely accumulated and clumped near the discharge port 18 is crumbled or loosened. Accordingly, compared to a structure without the fin structure 26, the likelihood of the developer being clumped near the discharge port 18 and clogging of the discharge port 18 due to the developer may be reduced.

In the toner cartridge TC according to the first exemplary embodiment, the shutter 19 is moved to the closed position when the toner cartridge TC is removed, and the shutter 19 is moved to the open position where the shutter 19 opens the discharge port 18 when the toner cartridge TC is mounted to the printer body U1.

In the state in which the shutter 19 is moved to the closed position, the brake rubber 32 is in contact with the projection 31. Thus, friction between the brake rubber 32 and the projection 31 acts as resistance applied to the rotation of the bottle 1.

It is assumed that the flange member 6, in which the discharge port 18 and the shutter 19 are disposed, is freely rotatable relative to the bottle 1. In this state, when handling of the toner cartridge TC is attempted while the bottle 1 is held, the flange member 6 may be rotated. This may cause the toner attracted around the shutter 19 to, for example, fly or to be attracted to the clothes of an operator. Thus, the toner cartridge TC is not necessarily easily handled and the operability of the toner cartridge TC may be degraded.

In particular, according to the first exemplary embodiment, the flange member 6 is attached to a leading end side in a mounting direction of the toner cartridge TC, that is, the rear side of the printer body U1. Thus, during mounting or detaching of the toner cartridge TC, the operator performs operation by holding a front end of the bottle 1 instead of the flange member 6. When the flange member 6 is freely rotatable relative to the bottle 1 with a very small force during the mounting of the toner cartridge TC to the printer body U1, it may be difficult to position an opening of a toner cartridge mounting portion and the flange member 6 relative to each other. Thus, it may be required that mounting is repeatedly attempted before the toner cartridge TC is successfully mounted to the printer body U1 or that the angle of the flange member 6 is checked during mounting work. This may greatly degrade the operability.

In contrast, according to the first exemplary embodiment, in the state in which the toner cartridge TC is detached from the printer body U1, the brake rubber 32 regulates the free rotation of the bottle 1 and the flange member 6 relative to each other. Thus, compared to the case where the bottle 1 and the flange member 6 are freely rotatable with a very small force, the operability may be improved.

Furthermore, according to the first exemplary embodiment, when the toner cartridge TC is mounted to the printer body U1, the shutter 19 is moved to the open position, and, as illustrated in FIG. 6B, the brake rubber 32 is separated from the projection 31. That is, due to separation of the brake rubber 32 from the projection 31, a contact state between the brake rubber 32 and the bottle 1 is changed. Thus, the resistance applied to the rotation of the bottle 1 is reduced. This suppresses an excessive increase of a rotational force, so-called torque, required to rotate the bottle 1 when the toner is supplied.

Furthermore, regarding the toner cartridge TC according to the first exemplary embodiment, the shutter 19 is moved in accordance with the mounting and detachment of the toner cartridge TC, thereby decreasing and increasing the resistance applied to the rotation. Thus, compared to the case where the user manually operates the resistance applied to the rotation, ease of the operation may be increased, and accordingly, the operability may be improved.

Second Exemplary Embodiment

Figure 7A:
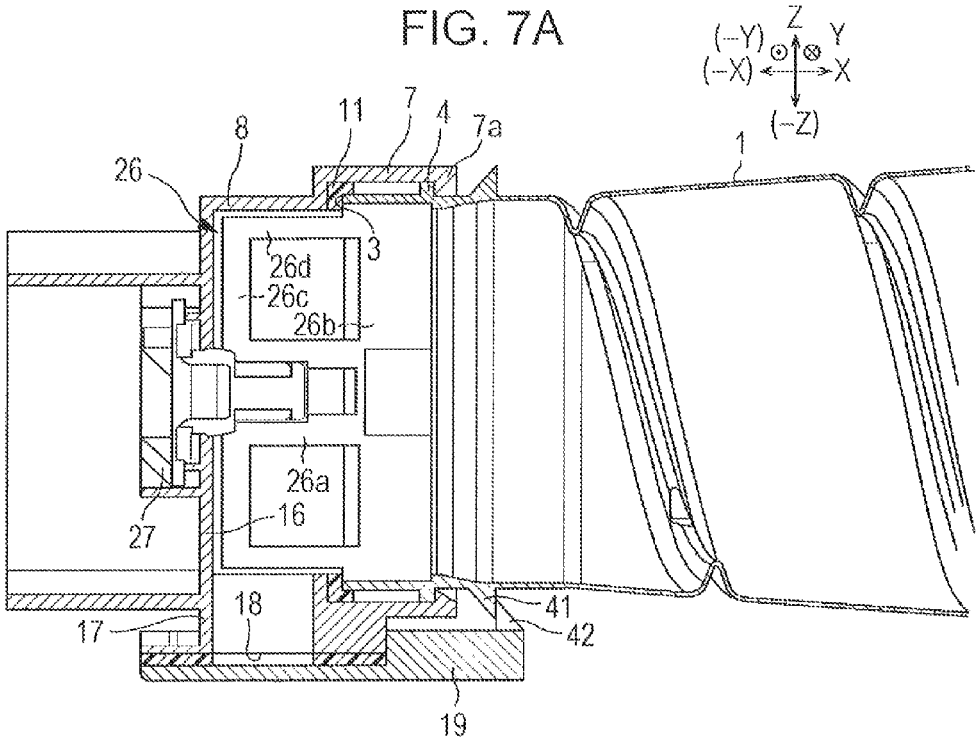
FIGS. 7A and 7B illustrate a toner cartridge according to a second exemplary embodiment corresponding to FIGS. 6A and 6B of the first exemplary embodiment, and out of FIGS. 7A and 7B.
Figure 7B:
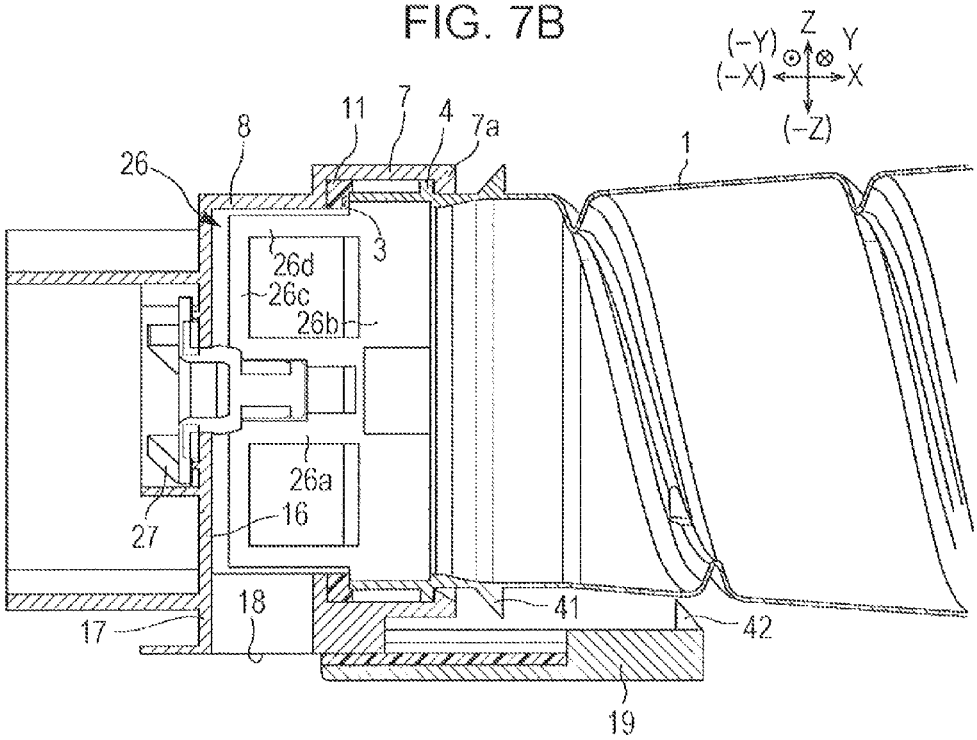

FIGS. 7A and 7B illustrate the toner cartridge according to a second exemplary embodiment corresponding to FIGS. 6A and 6B of the first exemplary embodiment. FIG. 7A is the explanatory view of a state in which the shutter has been moved to the closed position, and FIG. 7B is the explanatory view of a state in which the shutter has been moved to the open position.

Figure 8:
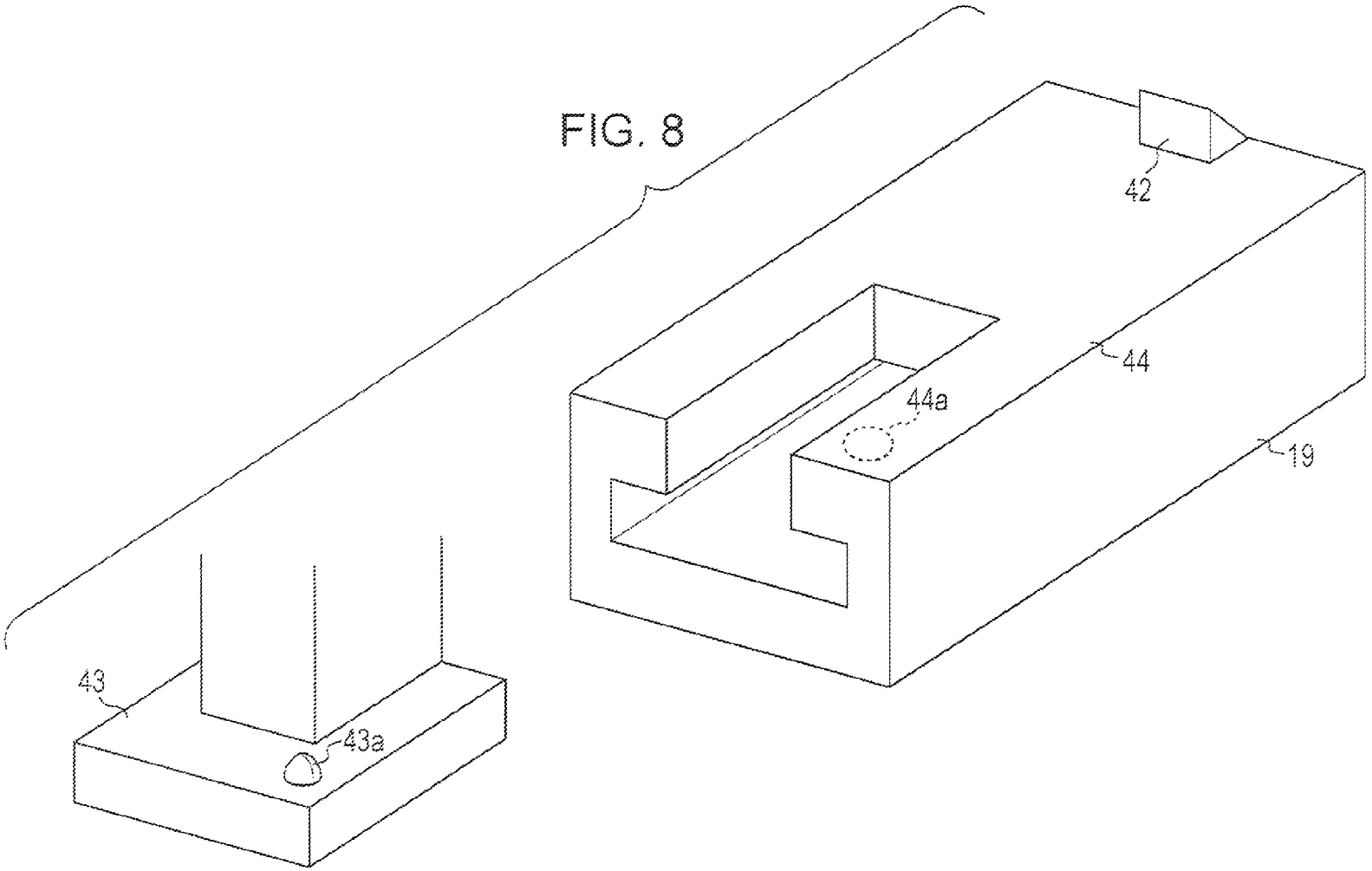
FIG. 8 is an explanatory view of part of the shutter according to the second exemplary embodiment.

FIG. 8 is an explanatory view of part of the shutter according to the second exemplary embodiment.

Next, the second exemplary embodiment of the present invention will be described. In this description of the second exemplary embodiment, elements corresponding to those of the first exemplary embodiment are denoted by the same reference signs and detailed description thereof is omitted.

Although the second exemplary embodiment is different from the first exemplary embodiment in the following points, the second exemplary embodiment has a structure that is the same as or similar to that of the first exemplary embodiment in other points.

Referring to FIGS. 7A and 7B, the toner cartridge TC according to the second exemplary embodiment includes a pressure receiving portion 41 and a pressing claw 42 instead of the projection 31 and the brake rubber 32 of the first exemplary embodiment. Referring to FIG. 8, a semi-spherical projection 43*a* is formed in a guide 43 in the flange member 6 of the toner cartridge TC according to the second exemplary embodiment. The projection 43*a* serves as an example of a holding member, and the guide 43 serves as an example of a guide portion that guides the shutter 19. The shutter 19 also has a semi-spherically shaped recess 44*a* in a portion to be guided 44 that is guided by the guide 43. The projection 43*a* is fitted into the recess 44*a*, so that the shutter 19 is held at the closed position when the shutter 19 is moved to the closed position illustrated in FIG. 7A.

In the toner cartridge TC according to the second exemplary embodiment, as illustrated in FIG. 7A, when the shutter 19 has been moved to the closed position, the pressing claw 42 serving as an example of the resistance reduction member is in contact with a front end surface of the pressure receiving portion 41. Also, as illustrated in FIG. 7B, when the shutter 19 has been moved to the open position, the pressing claw 42 is kept separated from the pressure receiving portion 41.

The resistance reduction mechanism according to the second exemplary embodiment includes the shutter 19, the pressure receiving portion 41, and the pressing claw 42.

When the shutter 19 is moved to the closed position, the pressing claw 42 presses the pressure receiving portion 41, thereby the bottle 1 is pressed rearward in the printer U according to the second exemplary embodiment having the above-described structure. This causes a portion of the bottle 1 where the opening 3 is formed to be squeezed into the seal 11 serving as an example of the resistive member according to the second exemplary embodiment. Thus, the resistance applied to the rotation of the bottle 1 acts so as to regulate free rotation of the bottle 1. According to the second exemplary embodiment, the projection 43*a* and the recess 44*a* are engaged with each other at the closed position. Thus, the bottle 1 is held while the bottle 1 is squeezed into the seal 11.

When the shutter 19 is moved to the open position, the pressing claw 42 is separated from the pressure receiving portion 41. This changes a contact state between the bottle 1 and the seal 11, that is, a squeezing state. That is, the squeezing of the bottle 1 into the seal 11 is reduced, and accordingly, the resistance applied to the rotation is reduced. Thus, the bottle 1 is rotatable with the resistance applied to the rotation reduced.

Accordingly, as is the case with the first exemplary embodiment, regarding the toner cartridge TC according to the second exemplary embodiment, the resistance between the bottle 1 and the flange member 6 is increased before the toner cartridge TC is mounted to the printer body U1, and the resistance applied to the rotation of the bottle 1 is reduced after the toner cartridge TC has been mounted to the printer body U1.

Third Exemplary Embodiment

Figure 9A:
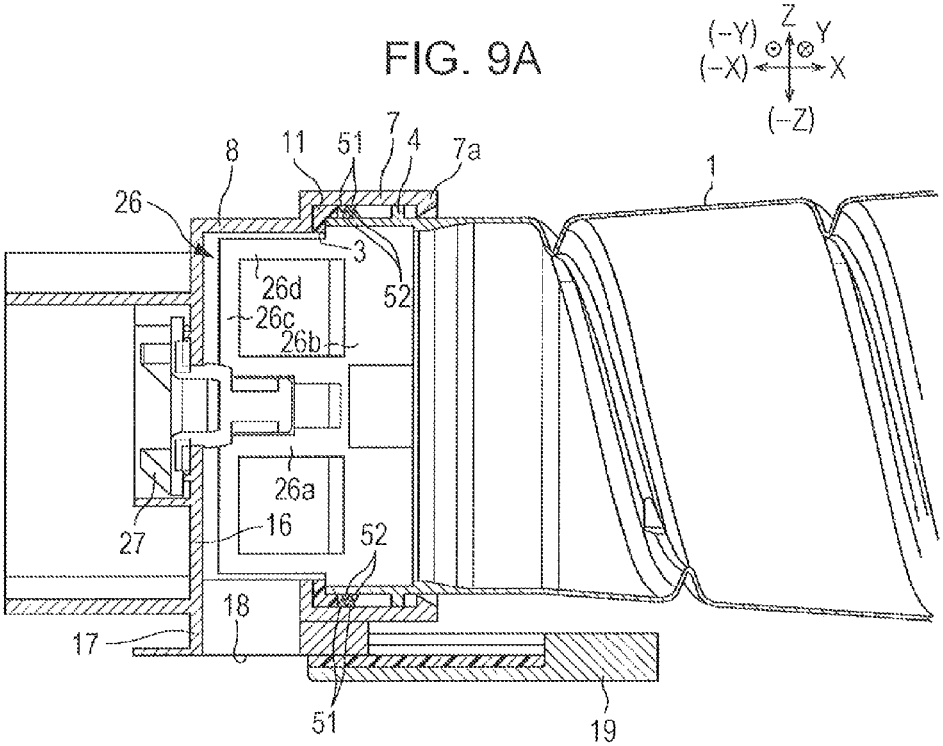
FIGS. 9A and 9B are explanatory views of a toner cartridge according to a third exemplary embodiment, and out of FIGS. 9A and 9B.
Figure 9B:
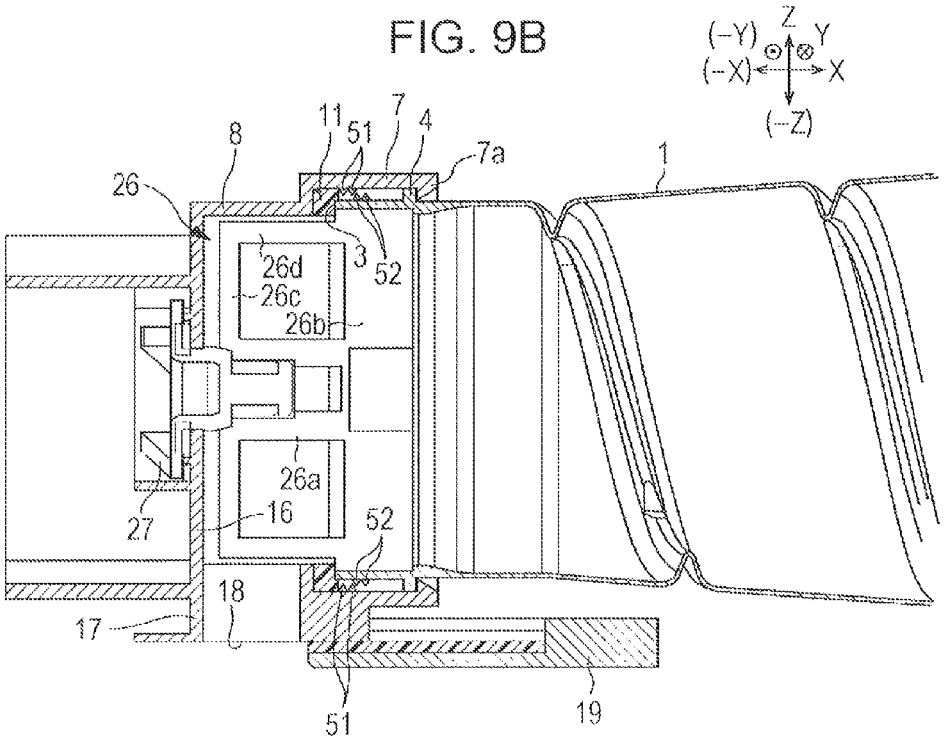

FIGS. 9A and 9B are explanatory views of the toner cartridge according to a third exemplary embodiment. FIG. 9A is an explanatory view of a state of the toner cartridge with screws tightened, and FIG. 9B is an explanatory view of a state of the toner cartridge with the screws loosened.

Next, the third exemplary embodiment of the present invention will be described. In this description of the third exemplary embodiment, elements corresponding to those of the first exemplary embodiment are denoted by the same reference signs and detailed description thereof is omitted.

Although the third exemplary embodiment is different from the first exemplary embodiment in the following points, the third exemplary embodiment has a structure that is the same as or similar to that of the first exemplary embodiment in other points.

Referring to FIGS. 9A and 9B, the projection 31 and the brake rubber 32 of the first exemplary embodiment are not provided in the toner cartridge TC according to the third exemplary embodiment. The toner cartridge TC according to the third exemplary embodiment has a first thread 51 in an inner circumferential surface of the large diameter portion 7 of the flange member 6. The first thread 51 serves as an example of a first screw portion. The first thread 51 is formed near the seal 11 that serves as the example of the resistive member. The toner cartridge TC also has a second thread 52 in an outer circumferential surface of a rear end portion of the bottle 1. The second thread 52 serves as an example of a second screw portion. The threads 51 and 52 of the third embodiment are formed in such directions that, when the bottle 1 is rotated for replenishment of the developer, the threads 51 and 52 are loosened, that is, the bottle 1 is moved forward.

Screw portions 51 and 52 that each serve as part of an example of the resistance reduction mechanism according to the third exemplary embodiment are formed of the threads 51 and 52.

In the printer U according to the third exemplary embodiment having the above-described structure, when the bottle 1 is rotated so as to tighten the threads 51 and 52 while the bottle 1 is pressed toward the flange member 6 so as to compress the seal 11, the seal 11 is held by the threads 51 and 52 while being compressed as illustrated in FIG. 9A. Thus, in this state, the bottle 1 is squeezed into the seal 11, and the resistance applied to the rotation of the bottle 1 is increased, so that free rotation of the bottle 1 relative to the flange member 6 is regulated.

When the toner cartridge TC is mounted to the printer body U1, and the bottle 1 is rotated along with a developer replenishing operation, the threads 51 and 52 are loosened and the bottle 1 is moved forward as illustrated in FIG. 9B. Accordingly, the contact state between the bottle 1 and the seal 11, that is, a squeezing state is changed. Thus, the degree of the squeezing of the bottle 1 into the seal 11 and the degree of tightness of contact of the bottle 1 with the seal 11 are reduced, thereby the resistance applied to the rotation is reduced. Accordingly, the bottle 1 is rotatable with the resistance applied to the rotation reduced.

Thus, as is the case with the first exemplary embodiment, regarding the toner cartridge TC according to the third exemplary embodiment, the resistance between the bottle 1 and the flange member 6 is increased before the toner cartridge TC is mounted to the printer body U1, and the resistance applied to the rotation of the bottle 1 is reduced after the toner cartridge TC has been mounted to the printer body U1.

Variations

Although the exemplary embodiments of the present invention have been described in detail, the present invention is not limited to the above-described exemplary embodiments. Many variations are possible without departing from the gist of the present invention described in the claims. Examples of variations (H01 to H08) of the present invention are described below.

H01: According to the above-described exemplary embodiments, the printer is described as the example of the image forming apparatus. However, the image forming apparatus is not limited to the printer. The image forming apparatus is applicable to, for example, an image forming apparatus of any one of a copier, a facsimile machine, and so forth.

H02: According to the above-described exemplary embodiments, an example structure is described in which the flange member 6 and the pressure receiving portion 41 are disposed on the leading end side in the mounting direction of the toner cartridge TC, that is, on the rear side of the printer U. However, this is not limiting. For example, a structure is also possible in which the flange member 6 and so forth are disposed on a trailing end side in the mounting direction, that is, on the front side of the printer U.

H03: According to the third exemplary embodiment, the positions where the threads 51 and 52 are disposed are not limited to the positions described as the examples described in the third exemplary embodiment. For example, the threads 51 and 52 may be provided at a boundary portion between a portion rotated in an integral manner with the bottle 1 and a portion of the flange member 6. Thus, the threads 51 and 52 may be provided at a boundary portion between the coupling 27 rotated in an integral manner with the bottle 1 and the wall portion 16 of the flange member 6.

H04: According to the first and second exemplary embodiments, an example structure is described in which the projection 31 and the pressure receiving portion 41 are provided in the bottle 1. However, this is not limiting. For example, the projection 31 and the pressure receiving portion 41 may be provided in a portion rotated in an integral manner with the bottle 1. For example, in a structure in which the fin structure 26 is exposed to the outside, the brake rubber 32 and the pressing claw 42 may be brought into contact with the fin structure 26.

H05: According to the exemplary embodiments, although the fin structure 26 is provided, the fin structure 26 may be omitted. Furthermore, although an example structure including two support arms 26*b* is described as the fin structure 26, this is not limiting. The fin structure 26 may include three or more support arms 26*b*.

H06: According to the exemplary embodiments, an example structure is described in which the coupling 27 that drives the bottle 1 is provided at the rear end. However, this is not limiting. For example, a structure is possible in which a coupling form is formed at the front end of the bottle 1 or a structure in which a gear is formed on the outer circumferential surface of the bottle 1 so as to rotate the bottle 1.

H07: According to the first exemplary embodiment, an example structure is described in which the brake rubber 32 and the projection 31 are completely separated. However, this is not limiting. For example, a structure is possible in which a contact area by which the brake rubber 32 and the projection 31 are in contact with each other is reduced so as to reduce the resistance applied to the rotation.

H08: Also, structures described in the exemplary embodiments may be combined with one another. For example, a structure that includes both the structures of the first and third exemplary embodiments is possible.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A container for developer detachably mountable to an image forming apparatus body, the container comprising:

a container body configured to contain developer and configured to be rotated about an axial direction when drive is transmitted from the image forming apparatus body;

a discharge member that supports the container body rotatable relative to the discharge member and that has a discharge port configured to discharge the developer;

a resistive member configured to be brought into contact with the container body so as to apply resistance to the rotation of the container body; and a resistance reduction mechanism configured to change a contact state between the resistive member and the container body so as to reduce the resistance between the resistive member and the container body when the container is mounted to the image forming apparatus body, wherein the resistance reduction mechanism includes an opening and closing member supported so as to be movable between an open position, where the opening and closing member opens the discharge port, and a closed position, where the opening and closing member closes the discharge port, by moving parallel to the axial direction of the container body, and wherein the resistive member is supported by the opening and closing member.

2. The container according to claim 1, wherein a contact surface between the resistive member and the container body is substantially perpendicular to the axial direction of the container body.

3. A container for developer detachably mountable to an image forming apparatus body, the container comprising:

a container body configured to contain developer and configured to be rotated when drive is transmitted from the image forming apparatus body;

a discharge member that supports the container body rotatable relative to the discharge member and that has a discharge port configured to discharge the developer;

a resistive member configured to be brought into contact with the container body so as to apply resistance to the rotation of the container body; and a resistance reduction mechanism configured to change a contact state between the resistive member and the container body so as to reduce the resistance between the resistive member and the container body when the drive is transmitted to the resistance reduction member after the container has been mounted to the image forming apparatus body, wherein the resistance reduction mechanism includes an opening and closing member supported so as to be movable between an open position, where the opening and closing member opens the discharge port, and a closed position, where the opening and closing member closes the discharge port, by moving parallel to the axial direction of the container body, and wherein the resistive member is supported by the opening and closing member.

4. A container for developer detachably mountable to an image forming apparatus body, the container comprising:

a container body configured to contain developer and configured to be rotated when drive is transmitted from the image forming apparatus body;

a discharge member that supports the container body rotatable relative to the discharge member and that has a discharge port configured to discharge the developer;

a resistive member that is configured to be brought into contact with the container body so as to apply resistance to the rotation of the container body;

a resistance reduction mechanism configured to change a contact state between the resistive member and the container body so as to reduce the resistance between the resistive member and the container body when the container is mounted to the image forming apparatus body; and an opening and closing member supported so as to be movable between an open position where the discharge port is opened and a closed position where the discharge port is closed, wherein the container has a boundary portion between the container body and the discharge member, wherein the resistive member includes an anti-leakage member disposed at the boundary portion so as to suppress leakage of the developer, wherein the resistance reduction mechanism is supported by the opening and closing member, wherein the container is configured such that, when the opening and closing member is moved to the closed position, the resistance reduction mechanism presses the container body toward the anti-leakage member, and wherein the container is configured such that, when the opening and closing member is moved to the open position, the resistance reduction mechanism is separated from the container body so as to reduce a force received by the container body from the anti-leakage member.

5. A container for developer detachably mountable to an image forming apparatus body, the container comprising:

a container body configured to contain developer and configured to be rotated when drive is transmitted from the image forming apparatus body;

a discharge member that supports the container body rotatable relative to the discharge member and that has a discharge port configured to discharge the developer;

a resistive member configured to be brought into contact with the container body so as to apply resistance to the rotation of the container body; and a resistance reduction mechanism configured to change a contact state between the resistive member and the container body so as to reduce the resistance between the resistive member and the container body when the drive is transmitted to the resistance reduction member after the container has been mounted to the image forming apparatus body, wherein the container has a boundary portion between the container body and the discharge member, wherein the resistive member includes an anti-leakage member disposed at the boundary portion so as to suppress leakage of the developer, wherein the resistance reduction mechanism includes a first screw portion formed in the discharge member and a second screw portion formed in the container body and engaged with the first screw portion, and wherein the container is configured such that, as the container body is rotated, the first screw portion and the second screw portion move the container body in a direction in which a degree of tightness of contact of the container body with the anti-leakage member is reduced.

6. An image forming apparatus comprising:

an image holding body;

a developing device configured to develop a latent image formed on a surface of the image holding body into a visual image; and the container according to claim 1 wherein the container is configured to contain the developer with which the developing device is replenished.

* * * * *